US006488556B2

(12) United States Patent
Galomb

(10) Patent No.: US 6,488,556 B2
(45) Date of Patent: Dec. 3, 2002

(54) TOY INCLUDING FLEXIBLE CONTAINER WITH MECHANICAL BASE AND METHOD OF MAKING SAME

(75) Inventor: David E. Galomb, Allentown, PA (US)

(73) Assignee: Fres-Co System USA, Inc., Telford, PA (US)

( * ) Notice: Subject to any disclaimer, the term of this patent is extended or adjusted under 35 U.S.C. 154(b) by 152 days.

(21) Appl. No.: 09/756,146

(22) Filed: Jan. 8, 2001

(65) Prior Publication Data

US 2002/0090879 A1 Jul. 11, 2002

(51) Int. Cl.[7] ..... A63H 3/00
(52) U.S. Cl. ..... 446/73; 446/78; 215/900
(58) Field of Search ..... 446/73, 78, 74, 446/71; 383/63, 86; 215/900; 220/666, 703

(56) References Cited

U.S. PATENT DOCUMENTS

| | | | | | |
|---|---|---|---|---|---|
| 2,102,329 | A | * | 12/1937 | Nelson et al. | 383/96 |
| 3,154,882 | A | * | 11/1964 | La Bossiere | 446/78 |
| 3,777,392 | A | * | 12/1973 | Span et al. | 446/78 |
| 3,799,914 | A | * | 3/1974 | Schmit et al. | 215/900 |
| 4,394,955 | A | * | 7/1983 | Raines et al. | 383/86 |
| 4,593,817 | A | * | 6/1986 | Ferrero | 446/73 |
| 4,930,644 | A | * | 6/1990 | Robbins, III | 215/900 |
| D310,252 | S | * | 8/1990 | Zimmerman | D21/450 |
| 5,035,324 | A | * | 7/1991 | Bertrand | 446/73 |
| 5,310,068 | A | * | 5/1994 | Saghri | 215/900 |
| 5,386,909 | A | * | 2/1995 | Spector | 446/73 |
| 5,632,377 | A | * | 5/1997 | Ferrero | 206/457 |
| 5,738,232 | A | * | 4/1998 | Roberts et al. | 446/74 |
| 6,176,755 | B1 | * | 1/2001 | Bye et al. | 446/78 |
| 6,237,787 | B1 | * | 5/2001 | Gallo et al. | 206/457 |
| 6,410,065 | B1 | * | 6/2002 | Nottingham et al. | 383/907 |

FOREIGN PATENT DOCUMENTS

| | | | | |
|---|---|---|---|---|
| WO | WO 9926864 A1 | * | 6/1999 | A63H/33/08 |

* cited by examiner

*Primary Examiner*—Derris H. Banks
*Assistant Examiner*—Urszula M Cegielnik
(74) *Attorney, Agent, or Firm*—Caesar, Rivise, Bernstein, Cohen & Pokotilow, Ltd.

(57) ABSTRACT

A toy including stand up flexible pouch or other flexible type pouch affixed to a rollable mechanical base and method of making the toy. When assembled, the toy may be manually or remotely controlled to roll or move about in a predetermined direction or fashion. The flexible pouch is shaped and printed to resemble a desired character while still maintaining its ability to contain a product. The base apparatus includes rolling members, e.g., wheels, to allow the base to be rolled or otherwise moved across a surface. The pouch and base are joined together, for example, by heat sealing, ultrasonic sealing, adhesives, etc. The rollable base may include a battery or other power source and/or electronics allowing for remote controllability of the assembled toy. The flexible pouch may contain a separate food or other product and a fitment, snap closure or other type of reclosure as desired.

18 Claims, 5 Drawing Sheets

FIG.1
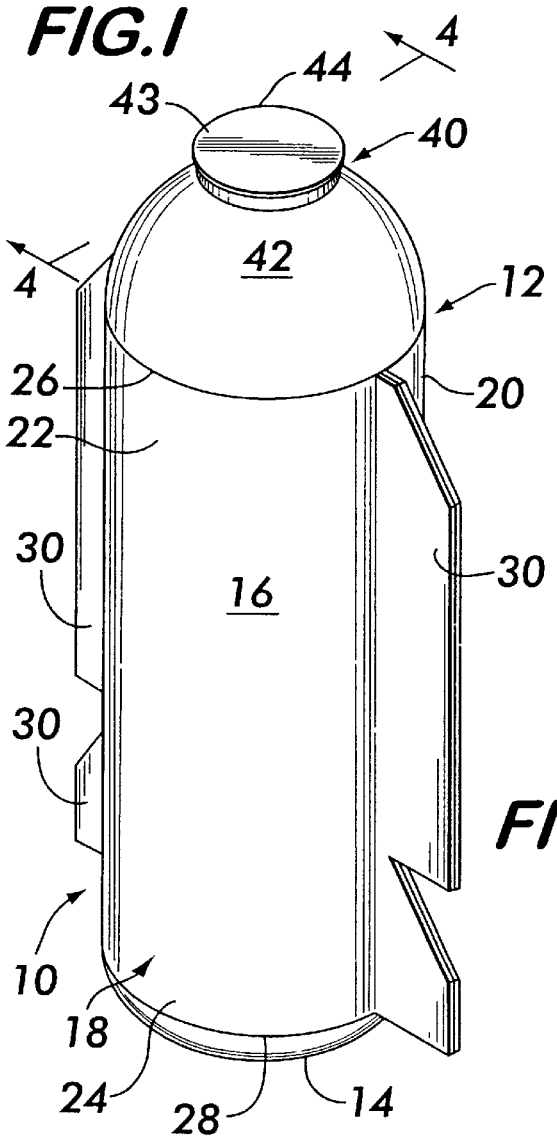
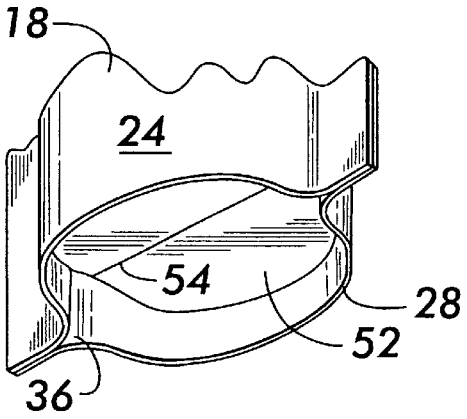
FIG.3
FIG.2
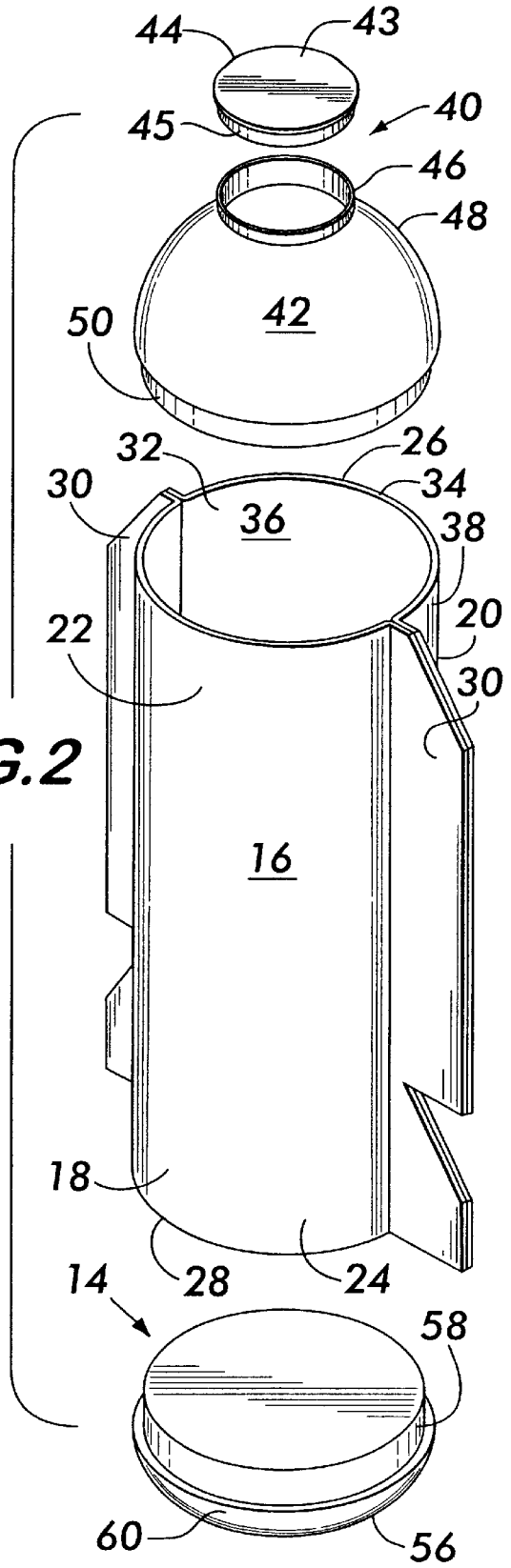

FIG.10
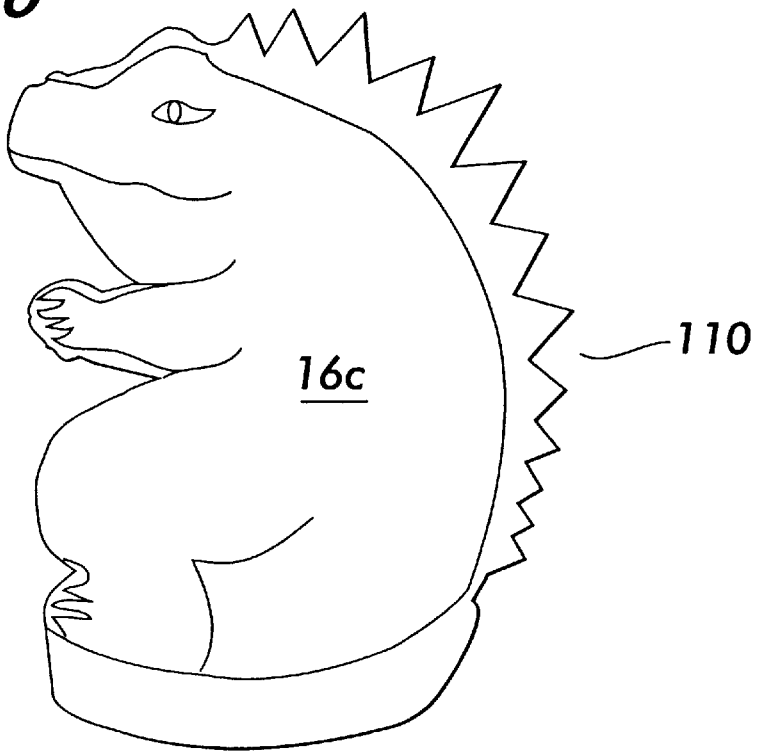
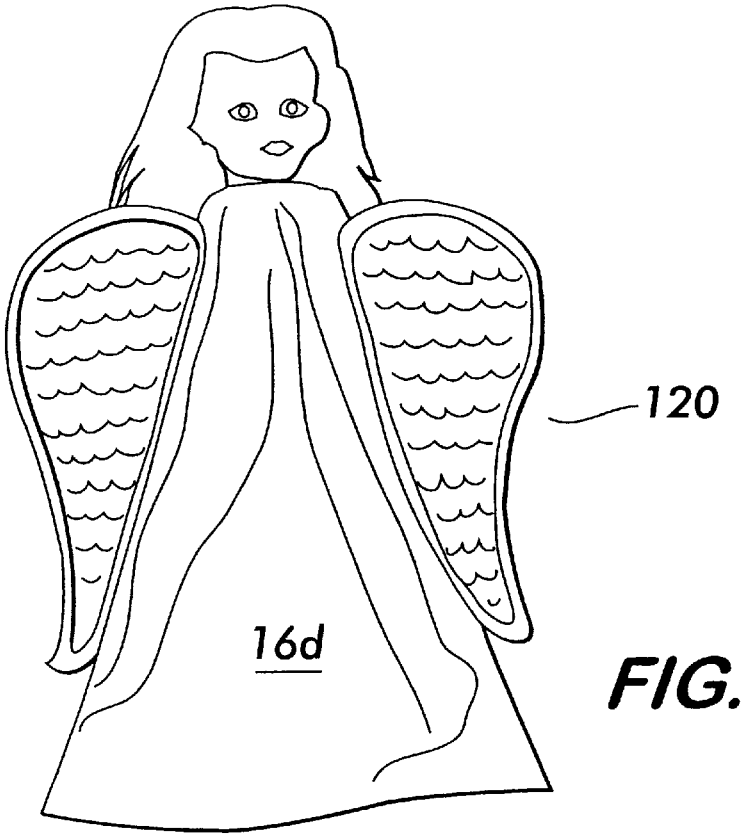
FIG.11

TOY INCLUDING FLEXIBLE CONTAINER WITH MECHANICAL BASE AND METHOD OF MAKING SAME

FIELD OF THE INVENTION

This invention relates to toys, and more particularly, to toys (e.g., robots, animated characters) that may be readily created and modified by changing the die cut shape of flexible packages for holding products (e.g., food stuffs) in a hermetically sealed condition (e.g., isolated from the ambient atmosphere).

BACKGROUND OF THE INVENTION

Toy manufacturers are inherently concerned with production expenses. Often in preparing plastic toys for mass production, a manufacturer goes through a lengthy mold making process. Injection molding is a primary process for manufacturing plastic parts for toys. Injection molding involves taking plastic of your choice in the form of pellets or granules and heating the plastic until a melt is obtained. Then the melt is placed into a split-die chamber/mold where it is allowed to cool and harden into the desired shape. The mold is then opened and the part is ejected, at which time the cycle may be repeated. While the cost per part is fairly low, the tooling is expensive.

Thermoforming is a technology that produces a three-dimensional structure from a two-dimensional thermoplastic sheet. The three-dimensional structure is formed by heating a thermoplastic sheet and then pulling it down onto a mold surface to shape the sheet. The structure is formed to the shape of the mold surface by vacuum forming. Then the structure is cooled and released from the mold.

A significant contributing factor to the costs of toy making is the speed of machining. Once a designer has conceived an approved design, it is imperative to convert the design concept into a prototype mold quickly since selling seasons are short. The life cycles of many toys are so short that the designers often work on very tight time schedules. Therefore, it would be beneficial to manufacture toys using a more economical solution.

Children today reap the benefits of the number of toys in the marketplace, with many children having thousands of toys to choose from at a store and hundreds of toys at their house. Despite the many available toys, a child generally has only a couple favorite toys. The other toys are either put into storage or sit around waiting for the child's attention, which is often fleeting. While many parents have ample space for their children's toys, there are some environments where space is limited. For example, children have limited space for playing with their toys in confined environments (e.g., a car), especially when space in the cramped environment is also needed to store luggage or groceries. For example, there may not always be ample space in a car for the car to hold groceries or luggage, and also to have space for many toys for the child to play with. Accordingly, it would be beneficial to provide toys that children can play with that can be used for holding a product.

SUMMARY OF THE INVENTION

These and other objects of this invention are achieved by providing a toy having an interior for holding a product (e.g., candy, coffee, cookies, foodstuff, etc.) therein. The toy is formed of a flexible material suitable for being hermetically sealed with the product located within its interior. The toy comprises a base having a bottom section arranged for moving against a surface (e.g., floor, wall, table top), and a stand-up sealable package that opens to define the interior. Preferably, the bottom section includes wheels or a transporting mechanism that rotates to roll or otherwise move the base in a predetermined manner. The base also includes an upper section having a predetermined circumference. The sealable package includes a bag or pouch having a front panel and a rear panel sealed to each other along their side edges. Each of the panels includes a lower lip having an outside surface and an inside surface. The inside surface is open to form a lower mouth therebetween. The toy is formed upon coupling the lower mouth about the circumference of the upper section of the base.

In a preferred embodiment, the package also comprises a flexible floor panel sealed to the pouch along the lower lip. The floor panel extends between the base and the interior of the package to close off and isolate the interior of the pouch from the base. In another preferred embodiment, the lower lips of the pouch are directly sealed to the base, preferably about the peripheral sides of the base. The pouch may also include a sealable upper section that opens to provide access to the interior of the pouch. The sealable section is arranged for closing and sealing the product in the interior of the package upon closure of the section. The sealable section may also include a fitment secured to the pouch. The fitment 40 preferably includes a connector (e.g., spout, valve) and a cap. The connector is hermetically sealed to the pouch and provides a conduit for access to the interior of the package. The cap securely attaches to the connector to seal the interior and disconnects from the connector to expose the interior for access therein.

The base preferably includes a motor that turns the wheels as desired to move the base against the surface. The base may also include a steering mechanism to control the direction and speed of rotation of the wheels. The steering mechanism can be adapted to control the wheels based on a signal received from a remote controller.

BRIEF DESCRIPTION OF THE DRAWINGS

The invention will be described in conjunction with the following drawings in which like-referenced numerals designate like elements and wherein:

FIG. 1 is an isometric view of one exemplary embodiment of a flexible toy in accordance with a first preferred aspect of the invention;

FIG. 2 is an exploded isometric view of the flexible toy of FIG. 1;

FIG. 3 is a partial isometric view of the bottom of the pouch shown in FIG. 1;

FIG. 10 is a side elevational view of a flexible pouch 16 having the shape of a toy in accordance with a fourth exemplary preferred embodiment of the invention; and FIG. 11 is a side elevational view of another flexible pouch having the shape of a toy in accordance with a fifth exemplary preferred embodiment of the invention.

DETAILED DESCRIPTION OF THE PREFERRED EMBODIMENT

Figure 4:
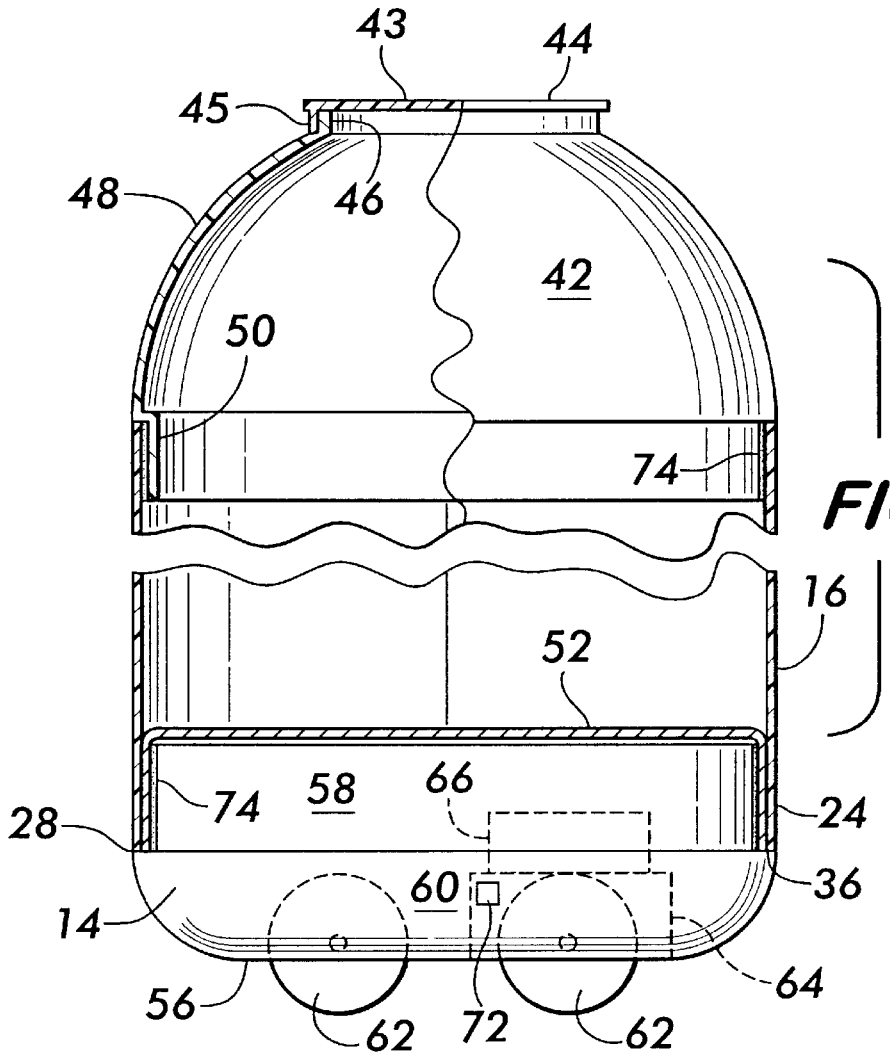
FIG. 4 is a side elevational view partially in section of the flexible toy taken along line 4—4 of FIG. 1.

Referring to FIGS. 1–3 there is shown at 10 a toy constructed in accordance with a first preferred embodiment of the invention. The toy 10 basically comprises a flexible package 12 (e.g., container) and a base 14. The package 12 is arranged to hold any particular material (e.g., candy, snack food, coffee, foodstuffs) and is suitable for packaging small amounts of such materials or for holding large amounts of such materials.

The package 12 includes a pouch 16 (e.g., bag) formed of a web of any conventional, flexible material, such as a laminated film. The pouch 16 basically includes a front panel 18, a rear panel 20, a sealable upper section 22 and a lower section 24. The sealable upper section 22 of the pouch 16 terminates in a top marginal edge 26. The lower section 24 of the pouch 16 terminates in a bottom marginal edge 28. Preferably the pouch 16 is die cut to form its shape, as will be described below.

As illustrated at FIGS. 1 and 2, the front and rear panels 18, 20 of the pouch 16 are coupled together at outer sides of the panels. The panels 18, 20 are coupled by any conventional sealing method, for example, heat sealing, ultrasonic sealing, adhesive (e.g., epoxy sealing, etc.). The coupling of the front and rear panels 18, 20 forms outer flanges or fins 30. Preferably the fin 30 extends longitudinally along the sides of the pouch 16 from the top marginal edge 26 to the bottom marginal edge 28. The fin 30 is formed by portions of the web material contiguous with the side vertical edges of the front and rear panels 18, 20 which are brought into engagement with each other and are secured to one another via the conventional sealing technique. In addition to providing a hermetic seal between the panels, the fins 30 increase the stability of the pouch 16, especially along portions of the pouch 16 closest to the fins 30.

The pouch 16 is shown in FIGS. 1 and 2 in an open configuration illustrating the hollow interior 32. The pouch 16 is flexible so that it can be economically formed and stored in a flattened configuration, with both the front and rear panels 18, 20 abutting each other to consume a minimal amount of space. When the pouch 16 is in its open configuration, the lower section 24 can bend as desired to conform to the shape of the base 14 to fit and seal the pouch 16 to the base 14 as will be described below. As shown in FIGS. 1 and 2, the sealable upper section 22 of the flexible pouch 16 is arranged to permit ingress to the product in the interior 32 of the package 12 and to seal the product from the ambient atmosphere. When the pouch 16 is formed as described above by coupling the front and rear panels 18, 20, the top marginal edge 26 forms an upper mouth 34. The upper mouth 34 includes an inner wall 36 along the inner circumference of the upper mouth 34, and an outer wall 38 along the outer circumference of the upper mouth 34.

As an example of a sealable upper section 22, FIGS. 1 and 2 show a fitment 40 comprising a connector 42 and a removable cap 44. As best shown in FIG. 2, the connector 42 includes an upper rim 46, a dome-shaped intermediate section 48 and a lower rim 50. The upper rim 46 forms a first opening and the lower rim 50 forms a second opening. The lower rim 50 is coupled at its circumference to the top marginal edge 26 of the pouch 16 to form a hermetic seal therebetween. The lower rim 50 is shown having a circumference slightly less than the circumference of the top marginal edge 26. This enables the lower rim 50 to fit snugly about the inner wall 36 of the upper mouth 34. It is also within the scope of this invention to provide a lower rim 50 that fits about the outer wall 38 of the upper mouth 34 or to provide a lower rim 50 that abuts the top of the upper mouth 34, as long as the connector 42 and the pouch 16 are hermetically sealed.

In this embodiment, the connector 42 is formed of any conventional lightweight material (e.g., plastic) and is semi-rigid having a dome-like shape. The intermediate section 48 extends from the lower rim 50 to the upper rim 46, and has a circumference that decreases toward the upper rim 46. The connector's upper rim 46 is basically cylindrical in shape and has a circumference less than the circumference of the lower rim 50. Coupling the connector 42 to the upper mouth 34 of the pouch 16 increases the stability of the pouch 16 towards the upper section 22 of the pouch 16. In other words, the upper section 22 of the flexible pouch 16 becomes more sturdy when it is attached to the semi-rigid connector 42 as is readily understood by a person skilled in the art. This increased stability enables the package 12 to stand and retain its shape for better use as a toy 10.

The removable cap 44 is arranged to seal the interior 32 of the package 12 from the atmosphere external to the package 12. As can best be seen in FIG. 2, the exemplary cap 44 has a flat disc-like top 43 and a cylindrical shaped flange 45 longitudinally extending from the underside of the top adjacent its outer rim. The cylindrical flange 45 is constructed to frictionally engage the upper rim 46 of the connector 42. For example, as shown in FIGS. 1 and 2, the cylindrical flange 45 couples about the upper rim 46 of the connector 42 when the cap 44 is placed upon the connector 42. The cap 44 connects to the connector 42 using any conventional method (e.g., screw or push on). This exemplary cap 44 is a push on lid with a flange 45 having an inner circumference about equal to the outer circumference of the upper rim 46 of the connector 42 such that the flange 45 frictionally extends about the outer circumference of the upper rim 46 to secure the cap 44 to the connector 42. The cap 44 can be placed on and taken off of the connector 42 as desired to access the contents of the interior 32 of the flexible pouch 16.

For safety purposes, the fitment 40 may also include a removable safety cover that forms a tamper-proof seal. This cover is placed over the first opening defined by the upper rim 46 of the connector 42 and provides a one-time seal notwithstanding the seal provided by the cap 44 placed over the upper rim 46 of the connector 42. The safety cover is preferably placed over the upper rim 46 after the package 12 is initially filled with a product and is removed by the user after purchase. Prior to its removal, the cover can be inspected to ensure that the package 12 was not tampered with by another prior to purchase.

As can be seen in FIGS. 3 and 4, the package 12 also includes a flexible floor panel 52 for sealing the lower section 24 of the package 12. The floor panel 52 is preferably formed of the same material as the front and rear panels 18, 20 (e.g., laminated film). The floor panel 52 is sized to extend across the interior 36 and abut the inner wall 36 of the front and rear panels 18,20. The floor panel 52 is secured to the inner wall 36 of the lower section 24 using any conventional sealing technique (e.g., heat sealing, welding, adhesive, etc.) to form a hermetic seal between the entire perimeter of the floor panel 52 and the lower section 24.

When the package 12 is flat, the floor panel 52 folds along a crease 54 and is substantially flat. When the package 12 is open, as shown in FIGS. 3 and 4, the floor panel 52 unfolds and forms a cup-like shaped layer having a vertically extending wall 68 sealed along the inner wall 36 of the lower section 24. In this manner, the floor panel 52 provides a layer between the interior 32 of the package 12 and the atmosphere external to the package 12 to seal the product in the package 12.

Figure 5:
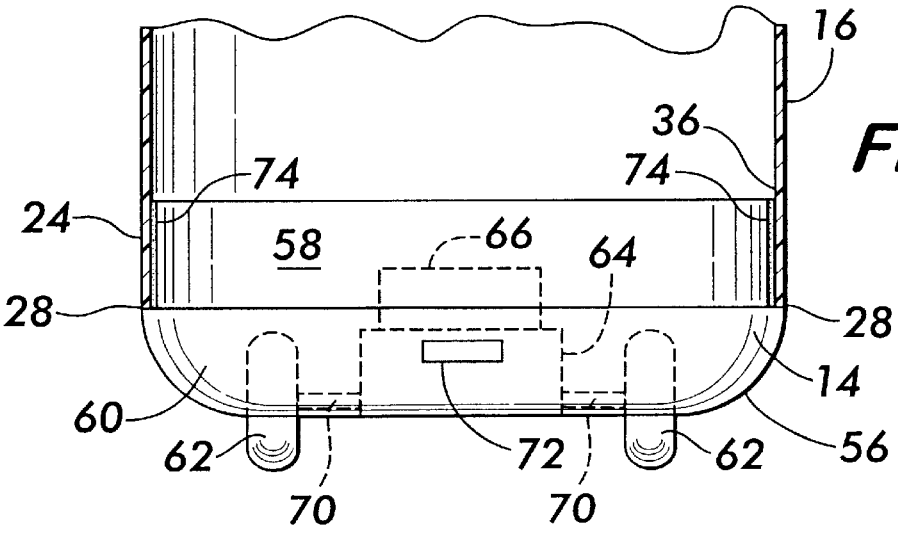
FIG. 5 is a partial side elevational view of the flexible toy of FIG. 1.
Figure 6:
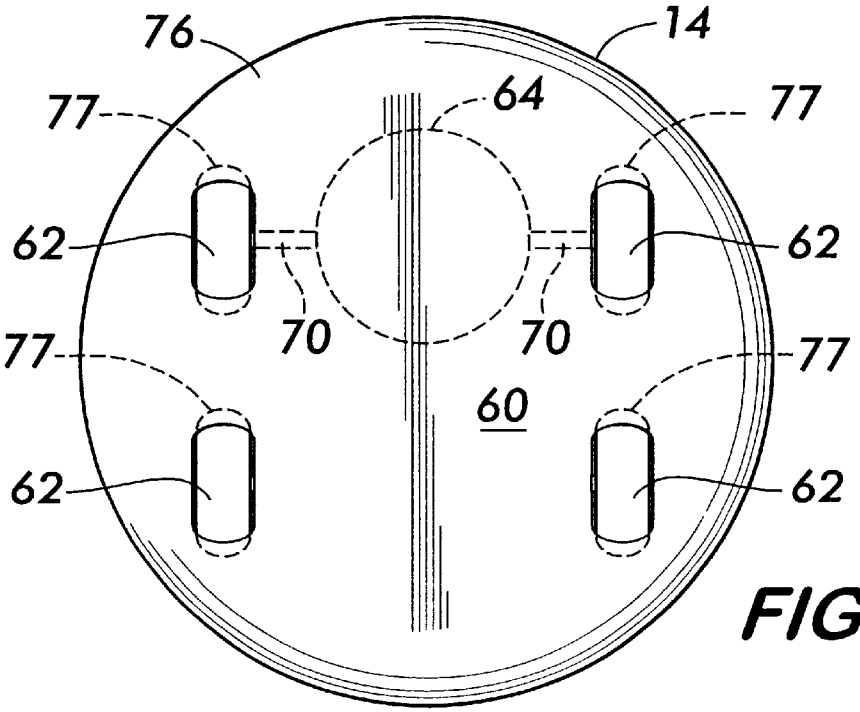
FIG. 6 is a longitudinal view of the base of the flexible toy shown in FIG. 1.

As can be seen clearly in FIGS. 4–6 the base 14 preferably has a cylinder-like shape and is rounded off of its bottom edge 56. The base 14 includes an upper region 58, a lower region 60, wheels 62, a motor 64 and a battery 66. As shown in FIGS. 4 and 5, the upper region 58 is fitted and secured within the inner wall 36 of the package 12. In FIG. 4, the upper region 58 is secured to the vertically extending wall 68 of the floor panel 52. In FIG. 5, the upper region 58 is sealed directly to the inner wall 36 of the lower section 24. While the upper region 58 can be sealed to the package 12 using any conventional method as discussed above for securing the panels together, the exemplary bases shown in FIGS. 4 and 5 are sealed to the package 12 with a layer of epoxy cement 74 between the radial peripheral side of the upper region 58 and the adjoining inner wall 36 of the floor panel 52 (FIG. 4) or lower section 24 (FIG. 5).

The wheels 62 of the base 14 rotate for rolling the toy 10 against a surface (e.g., floor, wall, table top). The battery 66 communicates with the motor 64 and provides power to the motor 64 for driving at least one of the wheels 62. The driving wheels 62 are attached to the motor 64 via axles 70 extending between the attached wheels 62 and the motor 64. The axles 70 rotate based on the motor 64 and turn the driving wheels 62. The base 14 may also include a steering mechanism 72 for turning the toy. The exemplary base 14 shows the steering mechanism 72 integrated with the motor 64. It is also within the scope of this invention to provide the steering mechanism 72 separate from the motor 64 and communicating with at least one of the wheels 62 to turn the toy as it moves along a surface. The motor 64 may also operate based on input from a remote controller as known to a skilled artesian for operating the movement of the toy.

As discussed above in FIG. 5, the pouch 16 is sealed directly to the base 14 to create a hermetic seal. The inner wall 36 of the lower section 24 surrounding the package 12 is preferably permanently sealed to the base 14 along a seam line formed between the periphery of the base 14 and the lower section 24 as described above and shown in FIG. 5. This approach provides the benefit of a hermetic seal formed along the bottom marginal edge 28 of the package 12 without the floor panel 52 shown in FIGS. 3 and 4.

FIG. 6 is a longitudinal view of the lower region 60 of the base 14. The lower region 60 includes a base floor 76, which supports the motor 64 and includes openings 77 through which each of the wheels 62 extend. In this example, the driving wheels 62 are connected to the axles 70 inside of the base 14 and extend through the openings 77 in the base floor 76 where they can roll along a surface. The free wheels 62 are rotatably coupled to the base 14, preferably at the base floor 76.

Figure 7:
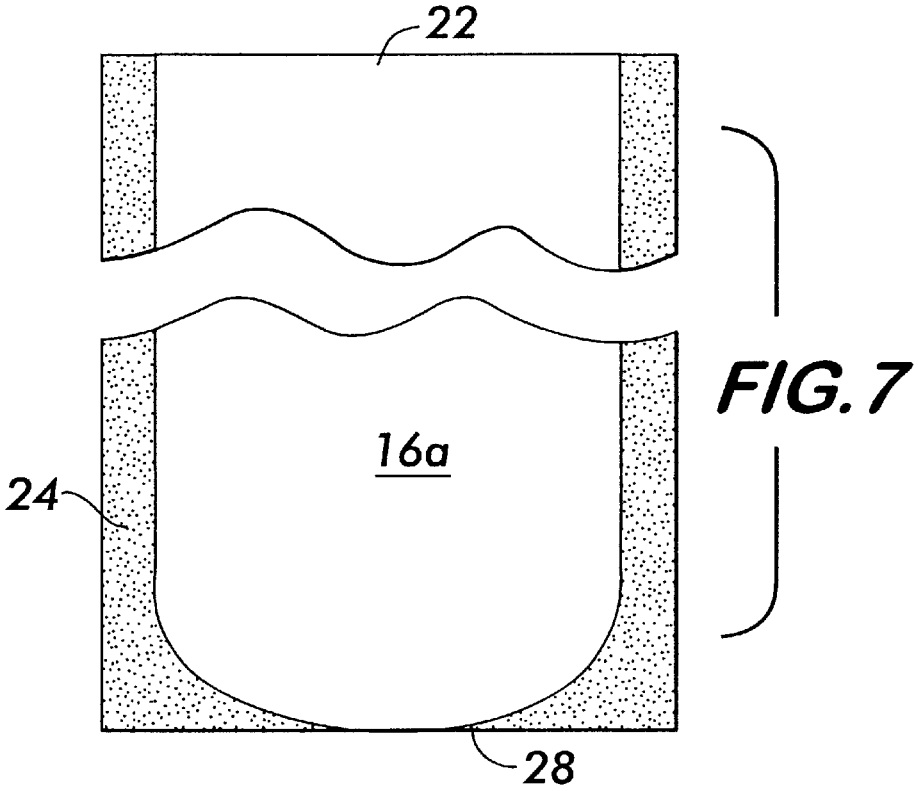
FIG. 7 is a side elevational view of a flexible pouch in accordance with a second exemplary preferred embodiment of the invention.

FIG. 7 shows a second exemplary preferred embodiment of the flexible pouch 16 In FIG. 7, the pouch 16*a* is formed by the front and rear panels 18, 20 of web material sealed along the peripheral sides and a lower section 24. The lower section 24 is sealed at the bottom marginal edge 28 along a curved seam line (FIG. 7) such that when the pouch 16*a* is opened, the lower section 24 rotates under the pouch 16*a* and forms a somewhat bowl-like configuration. Using this configuration, the pouch 16*a* preferably attaches to the top surface of the base 14 or within upwardly extending outer peripheral walls of the base 14. It is understood that the pouch 16*a* is securely sealed to the base 14 to prevent any unwanted separation during handling of the toy.

Figure 8:
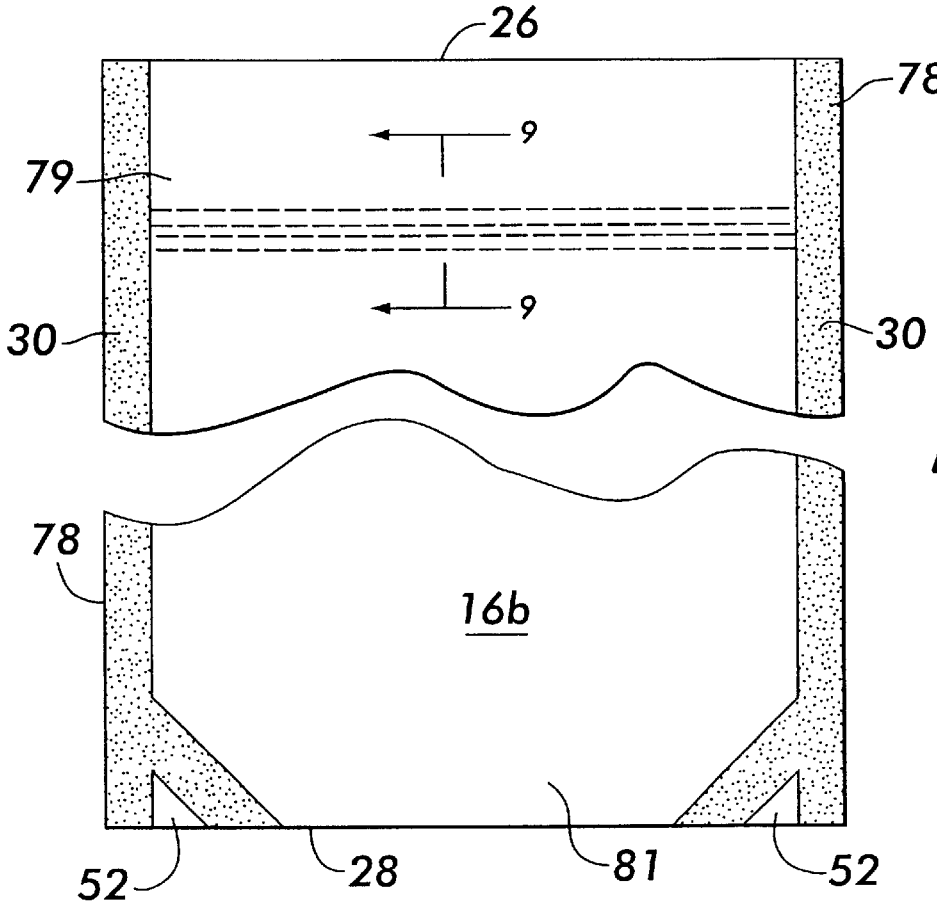
FIG. 8 is a side elevational view of a flexible pouch in accordance with a third exemplary preferred embodiment of the invention.

Another example of a flexible pouch is shown at FIG. 8. The pouch 16*b* basically comprises a front panel 18, a rear panel 20 and a gusseted floor panel 52. The front and rear panels 18, 20 have side edges 78, a top end portion 79 and a bottom end portion 81. The top end portions of the front and rear panels 18, 20 terminate in a top marginal edge 26. The bottom end portion of the front and rear panels 18, 20 terminate in a bottom marginal edge 28. The side edges 78 are hermetically sealed and form fins 30 using any conventional sealing technique as discussed above. As shown, side edges 78 of the front and rear panels 18,20 are sealed from the top marginal edge 26 to the bottom end portion 81.

The gusseted floor panel 52 of the flexible pouch 16*b* is an integral portion of a single sheet or web of the flexible material, of single or multiple ply or layers. The floor panel 52 has a width terminating at side edges 78. The width is substantially equal to the width of the front and rear panels 18, 20. The floor panel 52 also includes bottom edges that extend approximately to the bottom marginal edge 28 of the pouch 16*b*. The floor panel 52 is folded and seamed to form a floor layer having a crease 54 similar to the floor layer shown in FIG. 3. The floor panel 52 extends from the crease 54 to the bottom edges.

In this exemplary pouch 16*b*, the floor panel 52 is hermetically sealed to both the front panel 18 and the rear panel 20 along the side edges 78 and bottom marginal edge 28, thereby forming a gusseted bottom. An unfolded floor panel 52 forms a flattened floor layer similar to the floor layer shown in FIGS. 3 and 4. In this position, the pouch 16*b* becomes cylindrical at its bottom end portion 81, and the bottom marginal edge 28 of the front and rear panels 18, 20 is sufficiently planar so the pouch 16*b* can stand on its bottom marginal edge 28. In other words, when the pouch is opened, the gusseted bottom separates about its crease 54 to form a floor layer and vertically extending wall 68 as can be seen in FIG. 3. The flexible pouch 16*a* shown in FIG. 7 is an exemplary non-gusseted stand up package 12, and the flexible pouch 16*b* shown in FIG. 8 is an exemplary gusseted type stand up package 12.

Figure 9:
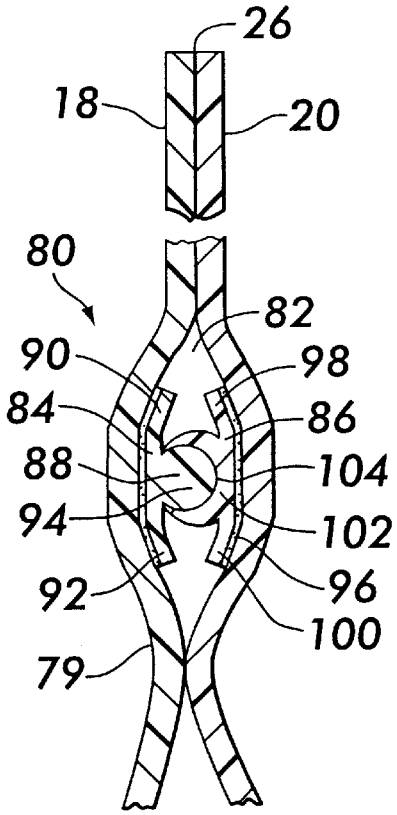
FIG. 9 is a sectional view of a snap closure of the pouch taken along line 9—9 of FIG. 8.

FIG. 9 illustrates an exemplary integrated snap closure 80 for reclosing and resealing the pouch 16 of FIG. 8 after the pouch 16 has been opened. As can be seen in FIGS. 8 and 9, the front and rear panels 18, 20 include an upper section 22, which between the panels 18, 20 define an opening 82 in the pouch 16. The snap closure 80 is provided within this opening 82. The snap closure 80 basically comprises a pair of snap strip members 84, 86 secured to respective portions of the front and rear panels 18, 20. Each of the strips 84, 86 is formed of a flexible material (e.g., a plastic material, such as high or low density polyethylene or polypropylene or some other material) which is slightly flexible to enable it to be bent out of its original shape by the application of force thereto, but returns to its original shape after removal of that force. Each strip 84, 86 extends the width of the panel 18, 20 to which it is secured. Each strip 84, 86 is arranged to be fixedly secured, e.g., welded or permanently adhesively secured to the inner surface of the upper section 22 of the respective panel 18, 20 adjacent the top marginal edge 26 and across the full width of the strip 84, 86.

The strip 84 basically consists of an elongated tongue-shaped member 88. In particular, this strip 84 includes an elongated planner upper flange section 90, an elongated planner lower flange section 92 and an intermediate projecting tongue section 94. The tongue section projects perpendicularly upward from respective planner flange sections 90, 92 and has a transversely cylindrical shape that appears bulbous in its cross section (FIG. 9).

The strip 86 basically consists of an elongated channel or recess-shaped member 96. In particular, the strip 86 includes an elongated planner upper flange section 98, an elongated planner lower flange section 100 and a generally C-shaped intermediate section 102 defining a groove or recess 104 therein.

The material forming the strips 84, 86 is somewhat elastic and/or flexible to enable the tongue 88 of the strip 84 to snap fit into the groove or recess 104 of the strip 86, and to be locked therein against accidental disconnection, yet which enable the tongue 88 to exit that recess 104 when the strips 84, 86 are pulled apart. It must be pointed out that the strips 84 and 86 can be mounted and secured to the rear panel 20 and front panel 18, respectively, instead of to the front panel 18 and rear panel 20, respectively. It must also be pointed out that the strips 84, 86 can be mounted and secured to the front and rear panels 18, 20 of the flexible pouch 16*a* shown in FIG. 7. Thus, the embodiments of FIGS. 7 and 8 are merely exemplary.

Notwithstanding their slight elasticity, the strips 84, 86 are substantially rigid so that when they are snapped together, the strips 84, 86 serve to hold the upper section 22 of the front panel 18 tightly against the top portion of the rear panel 20. The recess 104 of strip 86 tends to reinforce the strips 84, 86 and keep them linear to further insure that the opening 82 of the package 12 is sealed closed when the strips 84, 86 are snap connected to each other. Thus when the strips 84, 86 are snapped together, the contents of the pouch 16 are effectively isolated from the ambient surroundings so that it can be kept fresh over an extended period of time.

Other exemplary embodiments of the toys constructed in accordance with this invention are shown in FIGS. 10 and 11. The toy 110 shown in FIG. 10 is cut in the shape of an animal and includes a pouch 16*c* constructed in a substantially similar manner to that of the pouches and packages shown at FIGS. 1, 2, 7 and 8, and described heretofore. The shape of the pouches are defined by the shape of the die. The toy 120 shown in FIG. 11 is formed in the shape of an angel and includes a pouch 16*d* constructed in a substantially similar manner to that of the pouches and packages described heretofore. The pouches shown in FIGS. 10 and 11 are provided as examples of alternative toy figures that provide playful pleasure to a child. Both pouches can be filled with a product (e.g., candy, foodstuffs) and fixed to the base 14 as described above as a combination toy with food package 12. By providing a combination toy and food package 12 in one product, a child can play with the toy without taking up extra space for the product stored in the pouch 16. Accordingly, space is used more efficiently, because the same space is occupied as both a food package 12 and a toy.

It should be apparent from the aforementioned description and attached drawings that the concept of the present application may be readily applied to a variety of preferred embodiments, including those disclosed herein. Thus, as will be appreciated by those skilled in the art, the closures of this invention, the shapes of the package 12 and features of the toy 10 can be modified insofar as its construction and/or material composition is concerned in order to accommodate the preferred uses of the toy 10. For example, the package 12 can also have the shape of a robot or a vehicle (e.g., car, truck, airplane, train, etc.). In addition, the base can include other types of rolling members (e.g., one wheel, ball bearings, rollers, tractor treads, spoked hubs, etc.). The rolling member could also be placed horizontally (with a vertical axis) and rotate the toy about the axis. Moreover, the package need not be hermetically sealed. In fact other resealable approaches could be used in addition to the fitment and snap closure described herein. For example, the package could be provided with an easy opening top or tab. Further, the package could have a seal separate from the fitment such that the fitment is used after the package is initially opened by the user.

Without further elaboration the foregoing will so fully illustrate our invention that others may, by applying current or future knowledge, adopt the same for use under various conditions of service.

What is claimed is:

1. A toy having an interior for holding a product, said toy formed of a flexible material suitable for being hermetically sealed with the product located within said interior, said toy comprising:

a base having a bottom section arranged for moving on a surface, said bottom section including at least one rolling member to enable said base to roll across the surface, said base including an upper section having a predetermined circumference; and a sealable pouch that opens to define said interior, said pouch formed of a flexible material and having first and second panels connected to each other, each of said panels including a lower end portion having an outside surface, and an inside surface, said inside surfaces opening to form a lower mouth therebetween, said lower mouth being sealed about said circumference of said upper section of said base.

2. The toy of claim 1, said pouch further having a third panel sealed to said pouch along said lower end portion, said third panel extending between the base and the interior to close off and isolate said interior of said pouch from said base.

3. The toy of claim 2, said third panel being coupled to said lower mouth and said base along said circumference of said upper section.

4. The toy of claim 1, said pouch including a sealable end that opens to provide access to the product in said interior, said sealable end arranged for closing and sealing the product in said interior upon closure of said sealable end.

5. The toy of claim 4, said sealable end including a fitment that secures to said pouch.

6. The toy of claim 5, said fitment including a connector hermetically sealed to said pouch, said connector providing a conduit for access to said interior, said fitment also including a cap that removably couples to said conduit.

7. The toy of claim 4, said sealable end including inside portions that conjoin to form an upper mouth for said pouch, said upper mouth being openable to provide access to the interior of the toy, said upper mouth including a snap closure arranged for closing and sealing the product.

8. The toy of claim 1, said pouch configured to resemble a toy.

9. The toy of claim 1, said lower mouth being sealed about the outside of said upper section of said base.

10. The toy of claim 1, said lower mouth being sealed about the inside of said circumference of said upper section of said base.

11. The toy of claim 1, said base including a motor to turn said at least one rolling member as desired to roll said base across the surface.

12. The toy of claim 11, said base further including a steering mechanism to control the direction and speed of rotation of said at least one rolling member.

13. The toy of claim 12, said steering mechanism adapted to control said at least one rolling member based on input received from a remote control.

14. The toy of claim 1, wherein said rolling member comprises a wheel.

15. A method of making a toy for holding a product, the method comprising:

forming a sealable pouch of a flexible material suitable for being filled with a product, said pouch having first and second panels connected to each other, each of said panels including a lower end portion with an inside surface opening to form a lower mouth; and securing the sealable pouch to a mechanical base, said base arranged for moving on a surface.

16. The method of claim 15, further comprising sealing the lower mouth about the base.

17. The method of claim 15, further comprising controlling the movement of the base.

18. The method of claim 15, further comprising receiving a signal from a remote control, and controlling the movement of the base in accordance with the signal.

* * * * *